US005947851A

United States Patent [19]

Kicks et al.

[11] Patent Number: 5,947,851

[45] Date of Patent: Sep. 7, 1999

[54] DART

[75] Inventors: Ian James Kicks; Franklin David Stewart Bilotta, both of Suffolk, United Kingdom

[73] Assignee: Winmau Dartboard Co., Suffolk, United Kingdom

[21] Appl. No.: 09/121,282

[22] Filed: Jul. 23, 1998

[30] Foreign Application Priority Data

Jul. 23, 1997 [GB] United Kingdom ..... 9715554

[51] Int. Cl.[6] ..... A63B 65/02

[52] U.S. Cl. ..... 473/582

[58] Field of Search ..... 473/578, 582, 473/585, FOR 216, FOR 219, FOR 220

[56] References Cited

U.S. PATENT DOCUMENTS 4,230,322 10/1980 Bottelsen ..... 473/585
5,009,433 4/1991 Reid ..... 473/582
5,248,151 9/1993 Pickup ..... 473/585
5,611,543 3/1997 Bottelsen ..... 473/582

FOREIGN PATENT DOCUMENTS 2196267 4/1988 United Kingdom .

*Primary Examiner*—John A. Ricci
*Attorney, Agent, or Firm*—Arthur L. Plevy

[57] ABSTRACT

A dart has a body with a cavity at one end. A collar screwed into the cavity retains the head of a dart point within the cavity; the head of the dart point being able to move longitudinally within the cavity. The collar has fingers, which extend into the cavity, and which, in a first extended position of the dart point, grip a projection from, or a groove in, the dart point and maintains the body and the dart point in a relatively fixed relationship, whilst in a second position in which the dart point is withdrawn in the cavity allow the body and the dart point to rotate relative to one another.

5 Claims, 2 Drawing Sheets

DART

THIS INVENTION RELATES TO A DART

A dart has previously been proposed which has a body and a point that are movable longitudinally relative to one another under certain conditions. An example of such a dart is described in the specification of U.K. patent number 2,039,755, issued on Aug. 20, 1980, which claimed priority from U.S. Pat. No. 4.230,322.

The present invention is concerned with a dart which has an improved coupling between its body and a point, and which also enables a dart point to be interchanged more easily.

BRIEF DESCRIPTION OF THE DRAWINGS

Arrangements which are illustrative of the invention will now be described, by way of example, with reference to the accompanying drawings, in which.

DETAILED DESCRIPTION OF THE INVENTION

Figure 1:
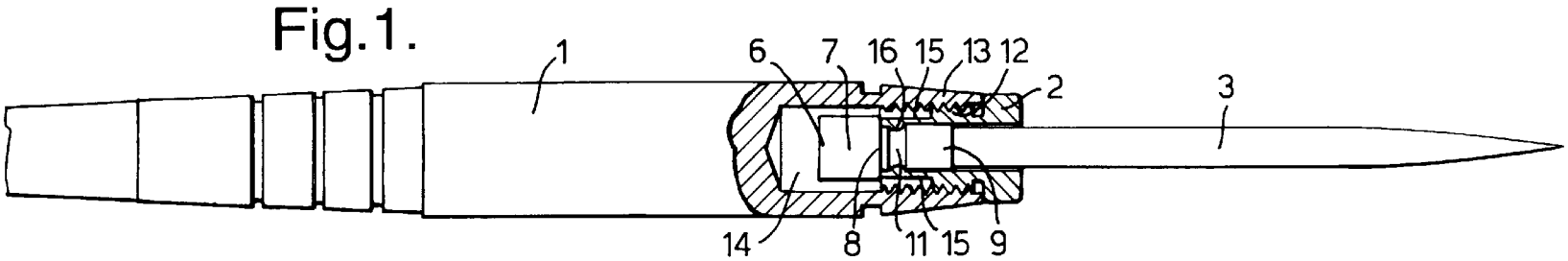
FIGS. 1 and 2 are side views, partly cut-away, of a dart having one form of point.

Referring to the drawings in which similar parts are given the same reference numbers, there are shown a part of a body 1, a collar 2 and points 3 and 4.

The part of the body shown in FIGS. 1 to 4 is cut-away at one end to enable the way in which the collar 2 and an end of each of the points 3 and 4 are assembled.

The point 3 is generally referred to As a "hard" point and is made of metal, such as steel, while the point 4 is made of a fairly rigid plastics material and is generally referred to as a "soft" point. The point 4 has a tip 5 which is less pointed than that of the point 3, but the less pointed tip 5 is still able to penetrate a dartboard and to function in the usual way. The point 4 is designed to be less likely to cause harm should it inadvertently strike a person.

The points 3 and 4 are designed to be interchangeable in the body 1.

Referring now, in particular, to FIGS. 1, 2, 5 and 6, the opposite end 6 to the pointed end of the point 3 has a head 7 with a shoulder 8 and a portion 9 which is of smaller diameter than the head 7. The portion 9 is spaced from the head 7 and shoulder 8 by a circumferential groove 11. The diameter of the portion 9 increases slightly from its end nearest to the pointed tip of the point 3 towards the circumferential groove 11.

The collar 2 carries a male threaded portion 12, which co-operates, in assembly, with a female threaded portion 13 in a first part of a cavity 14 in one end of the body 1.

From the end of the threaded portion 12 there extend four resilient fingers 15. Each of the fingers 15 has an internally projecting lip 16 at its free end.

Figure 6:
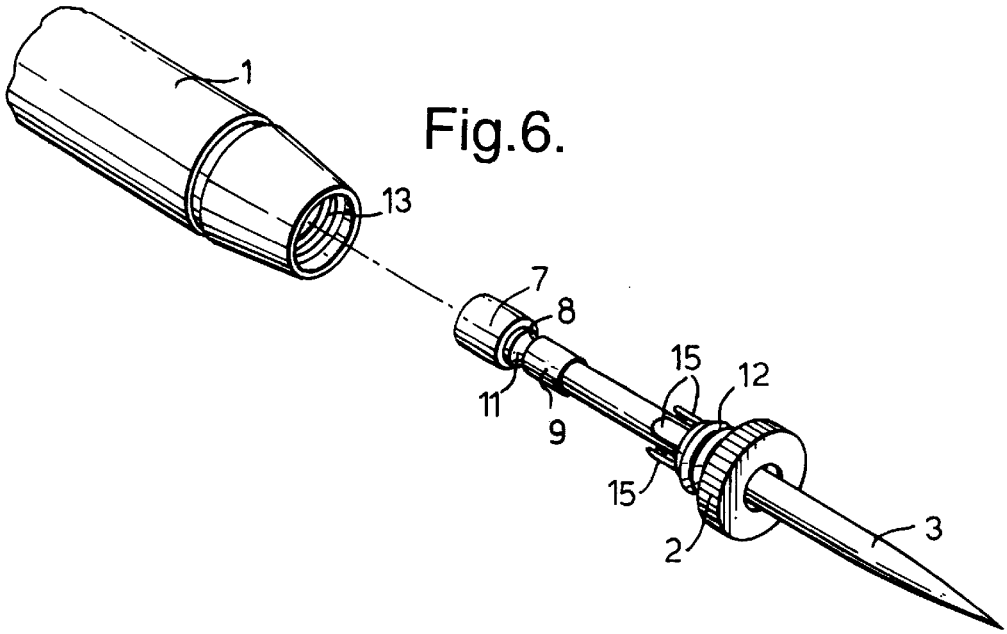
FIG. 6 is a perspective view from another angle of the collar shown in FIG. 5.
Figure 7:
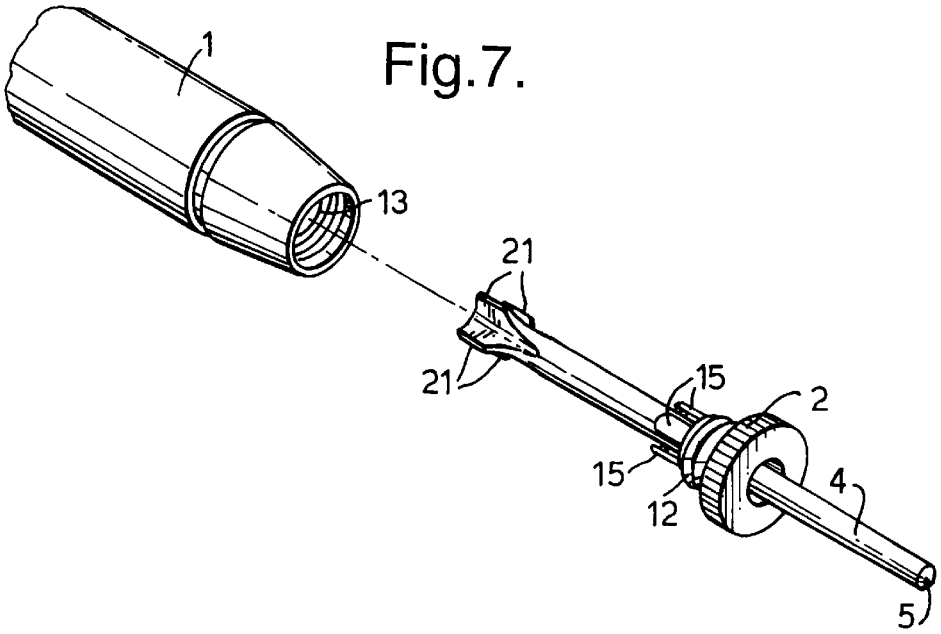
FIG. 7 is a perspective view of another form of dart point as shown in FIGS. 3 and 4.

In use, the parts may be assembled, as shown in FIG. 1, by inserting the pointed end of the point 3 into the opening which is bounded by the fingers 15 and which extends as a cylindrical hole through the collar 2, so that the collar 2 is, in effect, caused to slide along the point 3 until the fingers 15 encompass the portion 9 of the point 3, as best seen in FIG. 6. The threaded portion 12 of the collar 2 is then screwed into the threaded portion 13 in the one end of the body 1, thereby capturing the end 6 of the point 3 within the body 1.

The point 3 is held firmly in position by the force exerted by the engagement of the lips 16 of the fingers 15 in the circumferential groove 11 of the point 3. However, it is possible to overcome the force exerted upon the circumferential groove 11 by the fingers 15 by holding the point 3 against longitudinal movement and pushing the body 1 in the longitudinal direction towards the pointed end of the point 3, thereby causing the end 6 of the head 7 of the point 3 to move further into the cavity 14, as may be seen from FIG. 2.

Similarly, with reference to FIGS. 3, 4, 5 and 7, there is shown a "soft" point 4, having a comparatively blunt tip 5, and an end 20, opposite to the tip 5, which is formed with four fins 21. Similarly to the previously described embodiment, the arrangement is assembled by sliding the collar 2 along the point 4 until it reaches the end 20, where the fins 21 enter gaps between the resilient fingers 15. The fingers 15 grip the fins 21 and hold the point 4 and the collar 2 in a firm relationship. The collar 2 is then screwed into the end of the body 1, in the way previously described, and the assembly is ready for use. As with the arrangement described with reference to FIGS. 1 and 2, relative longitudinal movement is possible between the point 4 and the body 1, so that the fins 21 are moved from the position shown in FIG. 3 where they are gripped by the fingers 15 to the position shown in FIG. 4 in the cavity 14, where they are free of the fingers 15, thereby enabling the body 1 to rotate relative to the point 4.

Figure 3:
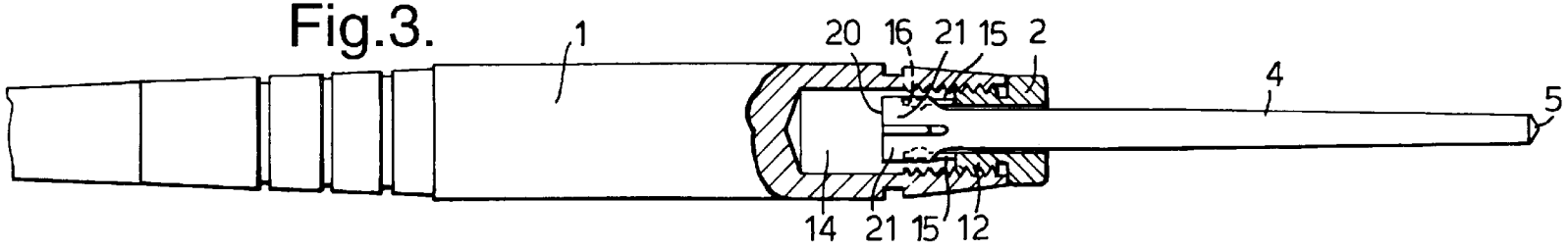
FIGS. 3 and 4 are side views, partly cut away, of the dart body shown in FIGS. 1 and 2 with another form of dart point.

Thus, a dart of each embodiment, that is one employing point 3 or 4, may be thrown, in the usual way, at a dartboard with the point firmly held in the position shown in FIG. 1 or FIG. 3 relative to the body 1. Upon striking and becoming embedded in a dartboard, the point 3 or 4 ceases to travel further, but, since there is considerable inertial energy in the body 1, the body 1 tends to continue to travel further and it becomes disengaged from either the point 3 or the point 4, as the case may be, by overcoming the forces which exist between the fingers 15 on the collar 2 and either the circumferential groove 11 of the point 3, or the fins 21 of the point 4.

Disengagement of the points 3 or 4 from the body 1 enables the body 1 to rotate freely with respect to either of the points with which it may be associated and thus when a dart has been thrown and its point has become embedded in a dartboard, a following dart, which may, for example, strike a part of the embedded dart, such as the flight, and which would otherwise be deflected, simply causes the body of the embedded dart to rotate about its point and is not deflected.

When a dart, which has its point embedded in a dartboard is to be removed from the board, the point 3 or 4 is held comparatively firmly in the board and the act of pulling on the body 1 causes the body 1 to be re-engaged with the point 3 or 4, as shown in FIG. 1 or FIG. 3, before the point 3 or 4 is withdrawn from the board.

The arrangements described enable a hard point and a soft point for a dart to be interchanged easily, and either assembly to have the facility of a dart body which rotates freely when the dart has been thrown and the point has become embedded in a dartboard and to be re-engaged with the point as a dart is removed from the board.

It will be understood that, although particular arrangements have been described, by way of example, in illustration of the invention, variations and modifications thereof, as well as other embodiments may be made which employ the invention.

Figure 2:
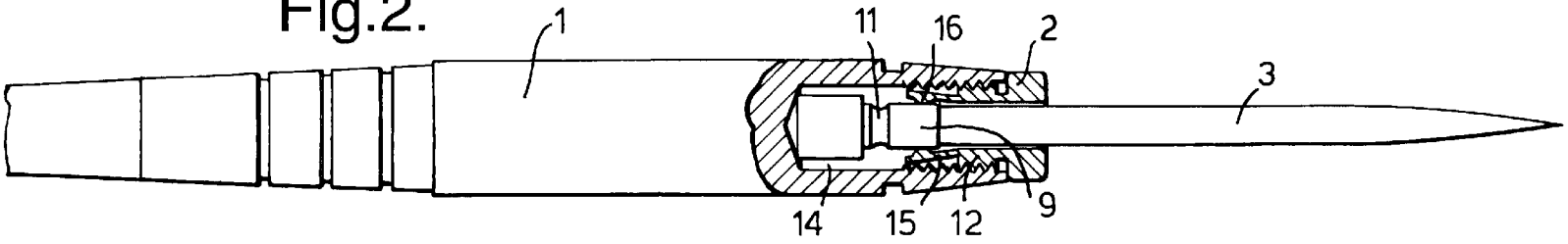

For example, although the cooperating means in the arrangement of FIGS. 1 and 2 are lips 16 at the free ends of fingers 15 and a circumferential groove 11 in the point 3, there may, for example, be a circumferential projection on the point 3 cooperating with corresponding depressions in the free ends of the fingers 15.

Figure 4:
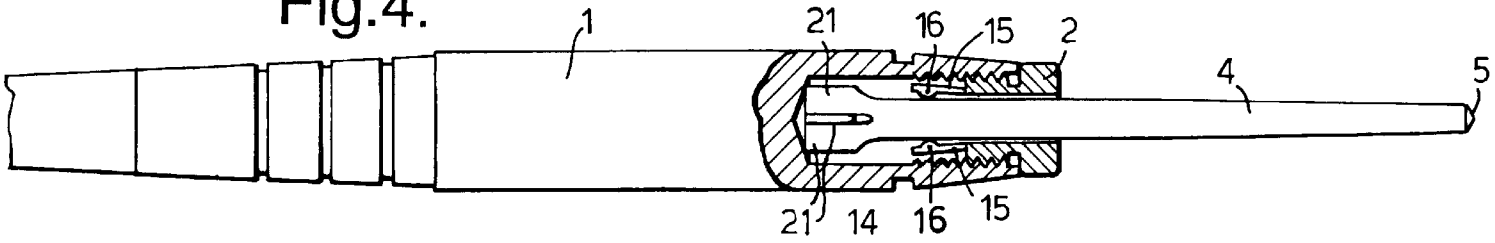
Figure 5:
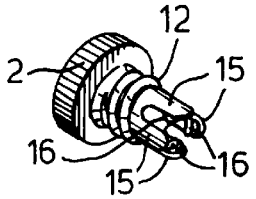
FIG. 5 is an exploded perspective view of one end of the dart body, a collar and the one form of point.

Similarly, in the arrangement of FIGS. 3 and 4, instead of fins 21 cooperating with the gaps between the fingers 15, the fingers 15 may enter spaces between fins on the point 3, and be gripped by the fins to provide the cooperating means.

We claim:

1. A dart having a body, a dart point, a tip at one end of the dart point, a cavity in one end of the body, and a collar, the collar when assembled with the body retaining, in the cavity, a part of the dart point which is remote from the tip, and the collar having fingers extending into the cavity, a part of the dart point which is remote from the tip having means therein, or extending therefrom, for cooperation with the fingers which extend from the collar into the cavity, the means, which is therein or which extends from the part of the dart point, cooperating with the fingers to hold the point and the body in a relatively fixed first position, in which the dart point is extended from the body, and allowing the point and the body to rotate relatively with respect to one another in a second position in which the dart point is withdrawn in the cavity.

2. A dart as claimed in claim 1 having a circumferential groove in the dart point, and a lip projecting from the fingers for cooperation with the groove when the point is in the first position.

3. A dart as claimed in claim 2 having a "hard" (as herein defined) dart point.

4. A dart as claimed in claim 1 having fins projecting from the dart point for entry into gaps between the fingers when the point is in the first position.

5. A dart as claimed in claim 4 having a soft, (as herein defined) dart point.

* * * * *